US005713766A

United States Patent [19]

Davies et al.

[11] Patent Number: 5,713,766

[45] Date of Patent: Feb. 3, 1998

[54] DEPLUGGABLE BARRIER TERMINAL STRIPS

[75] Inventors: Brian F. Davies, Londonderry; Anthony J. Peleckis, Laconia; Gary H. Robertson, Gilford, all of N.H.

[73] Assignee: Axsys Technologies, Gilford, N.H.

[21] Appl. No.: 619,308

[22] Filed: Mar. 21, 1996

[51] Int. Cl.[6] ..... H01R 9/22

[52] U.S. Cl. ..... 439/709

[58] Field of Search ..... 439/709–719, 439/721, 723, 725, 638

[56] References Cited

U.S. PATENT DOCUMENTS

| | | | |
|---|---|---|---|
| 2,991,440 | 7/1961 | Kulka . | |
| 3,883,210 | 5/1975 | Fujita et al. . | |
| 3,980,383 | 9/1976 | Dickey et al. . | |
| 4,239,324 | 12/1980 | Stenz . | |
| 4,698,029 | 10/1987 | O'Connor | 439/532 |
| 4,725,240 | 2/1988 | Braverman | 439/105 |
| 5,407,367 | 4/1995 | Robertson | 439/716 |
| 5,427,550 | 6/1995 | Jaag | 439/709 |
| 5,451,170 | 9/1995 | Suffi | 439/404 |

*Primary Examiner*—Khiem Nguyen
*Attorney, Agent, or Firm*—Scully, Scott, Murphy and Presser

[57] ABSTRACT

Electric barrier terminal strips which enable conversion from a screw type format of wiring terminals to a higher pitch row of female connectors. To compensate for the larger spacings between the screw type format of screw wiring terminals, the screw type wiring terminals can be arranged in first and second rows, either staggered or not, one on each side of the row of female connectors. Individual female connectors in the row are connected alternatively with a screw wiring terminal from the first row and a screw wiring terminal from the second row. The single row of female connectors can be arranged in a EURO format housed within a EURO style shroud, for connection to a row of conductor pins in a EURO style header. Alternatively, the single row of female connectors can be provided near a flat bottom surface of the barrier terminal strip, for connection to a row of conductor pins projecting from a printed wiring or circuit board. The first and second adjacent rows of screw wiring terminals can be positioned at different heights or at the same height. Alternatively, the screw wiring terminals can be arranged in a single row, and are connected to alternate ones of the female connectors.

20 Claims, 5 Drawing Sheets

DEPLUGGABLE BARRIER TERMINAL STRIPS

BACKGROUND OF THE INVENTION

1. Field of the Invention

The present invention relates generally to depluggable barrier terminal strips, and more particularly pertains to depluggable barrier terminal strips which provide a screw type barrier terminal strip and female connectors for connection to a EURO style header or a row of conductive pins projecting from a printed wiring or circuit board.

2. Discussion of the Prior Art

The prior art discloses many different types and arrangements of pluggable barrier terminal strips and headers. For instance, Kulka U.S. Pat. No. 2,991,440 discloses a screw type terminal connector for printed circuits having two rows of vertically displaced and staggered wiring terminals. Fujita et al. U.S. Pat. No. 3,883,210 illustrates a socket assembly having four rows of vertically displaced wiring terminals. Dickey et al. U.S. Pat. No. 3,980,383 discloses a multiplane terminal block having two rows of vertically displaced and staggered wiring terminals. Stenz U.S. Pat. No. 4,239,324 concerns a terminal block for printed circuits having vertically staggered wiring terminals. O'Conner U.S. Pat. No. 4,698,029 discloses a EURO style connector assembly. Robertson U.S. Pat. No. 5,407,367 discloses a barrier terminal strip assembly having two rows of vertically displaced wiring terminals. Jaag U.S. Pat. No. 5,427,550 concerns a multi-terminal connector block with two rows of vertically displaced and staggered wiring terminals. Suffi U.S. Pat. No. 5,451,170 discloses a terminal block having two rows of vertically displaced connectors which are positioned above two rows of female electrical terminals.

In general, the prior art discloses barrier terminal strips and connectors having elevationally offset rows of wiring terminals, some of which are also staggered. However, the offset rows of the prior art terminal blocks are always for a different purpose than that of the present invention, not for the purpose of allowing a set of screw type wiring terminals to interface with a set of more compactly arranged (higher pitch) female connectors, similar to the present invention.

SUMMARY OF THE INVENTION

Accordingly, it is a primary object of the present invention to provide depluggable barrier terminal strips.

A further object of the subject invention is the provision of a screw type pluggable barrier terminal strip or block having at least one row of screw type wiring terminals connected to a row of female connectors, with the rows having different pitches between the screw wiring terminals and the female connectors.

The present invention provides screw type electrical barrier terminal strips which can be repeatedly connected, mechanically and electrically, with a row of conductive pins, such as a row of pins attached to a printed wiring or circuit board, or a row of pins secured within a nonconductive shroud or header. The pins can be in rows, nominally evenly spaced on centerlines, including but not limited to 3.5 mm, 3.81 mm, 5.0 mm, 5.08 mm, 7.5 mm, 7.62 mm and 8.26 mm. The pins may or may not be secured within an outer nonconductive shroud, which can be a EURO style header, which may or may not have a scallop shape. The barrier terminal strip can have one or more rows of screw wiring terminals, placed on one or more planes. The wiring terminal plane can be positioned at any angle between 0 and 180 degrees relative to the row of conductive pins.

The present invention provides electric barrier terminal strips to enable conversion from screw type wiring terminals to a higher pitch row of female connectors in order to plug the barrier terminal strip into a single row of male connector pins, projecting from a printed wiring or circuit board, or secured within an outer nonconductive shroud, which can be a EURO style header. To compensate for the larger spacings between the screw type wiring terminals, compared with the row of female connectors, the screw type wiring terminals can be arranged in two rows, either staggered or not, one on each side of the row of the female connectors, with each row of screw type wiring terminals being at the same height or being vertically displaced at different heights, thereby providing ready access to each individual wiring terminal.

In accordance with the teachings herein, the present invention provides a pluggable barrier terminal strip comprising at least one row of screw wiring terminals defining a first pitch between adjacent screw wiring (external conductor clamped, threaded) terminals. The barrier terminal strip further comprises a single row of female connectors defining a second pitch between adjacent female connectors, which is a higher pitch that the first pitch between adjacent screw wiring terminals, and wherein individual female connectors are electrically connected to individual screw wiring terminals. In this arrangement, the single row of female connectors can be repeatedly connected, both mechanically and electrically, with a row of conductive pins.

In greater detail, the pluggable barrier terminal strip includes first and second adjacent rows of screw wiring terminals, with the first row of screw wiring terminals being positioned on a first side of the single row of female connectors, and the second row of screw wiring terminals being positioned on a second opposite side of the single row of female connectors. Individual female connectors in the row are connected alternately with a screw wiring terminal from the first row and a screw wiring terminal from the second row, to compensate for the higher pitch of the single row of female connectors. The first and second rows of screw wiring terminals can be arranged in a NEMA format. The single row of female connectors can be arranged in a EURO format housed within a EURO style shroud, for connection to a row of conductor pins in a EURO style header. Alternatively, the single row of female connectors can be provided near a flat bottom surface of the barrier terminal strip, for connection to a row of conductor pins projecting from a printed wiring or circuit board, with the flat bottom surface seated against the flat surface of the printed wiring or circuit. In several embodiments, the first and second adjacent rows of screw wiring terminals are positioned at first and second different heights with respect to the single row of female connectors. Alternatively, the first and second adjacent rows of screw wiring terminals can be positioned at the same height with respect to the single row of female connectors.

In several embodiments, the first and second rows of screw wiring terminals are staggered with respect to each other, such that the first and second rows of the screw wiring terminals are a fraction of a pitch apart with respect to each other. Alternatively, the first and second rows of screw wiring terminals can be positioned in line with respect to each other in a nonstaggered manner, such that the first and second rows of wiring terminals are positioned aligned with respect to each other.

In different embodiments, the first and second rows of screw wiring terminals are spaced equal distances on each side of the single row of female connectors. Alternatively, the first and second rows of screw wiring terminals can be spaced at unequal distances on each side of the single row of female connectors to provide an offset to the mating portion of the terminal block.

In several alternative embodiments, the screw wiring terminals are arranged in a single row, and the screw wiring terminals are connected to alternate ones of the row of the female connectors to compensate for the higher pitch of the row of female connectors.

BRIEF DESCRIPTION OF THE DRAWINGS

The foregoing objects and advantages of the present invention for depluggable barrier terminal strips may be more readily understood by one skilled in the art with reference being has to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 5:
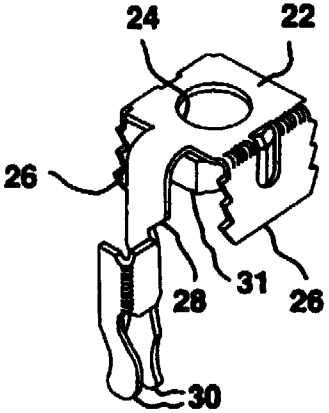
Figure 15:
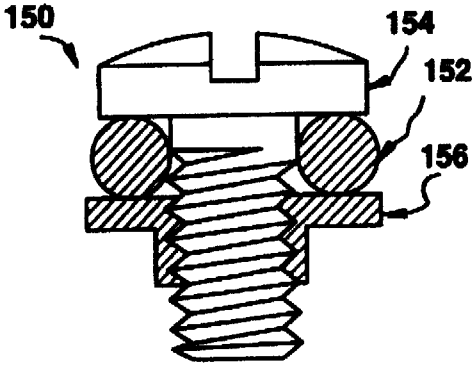
FIG.15 PRIOR ART
FIG. 15 illustrates a typical prior art screw type wiring terminal which secures the conductor(s) of one or more wires between the underside of a screwhead of a screw threaded into a conductive terminal.

Referring to the drawings in detail, FIG. 15 illustrates a typical prior art screw type wiring terminal 150 which secures the conductor(s) 152 of one or more wires between the underside of a screwhead 154 or screwhead/washer in combination, adjacent to the screw shank, and a threaded, conductive terminal 156 or conductive terminal/threaded plate in combination, or a conductive terminal and backing nut in combination, similar in concept to that illustrated in FIG. 5. Screw type terminals are commonly arranged into elongated insulators having standing barriers to form barrier terminal strips.

Figure 16:
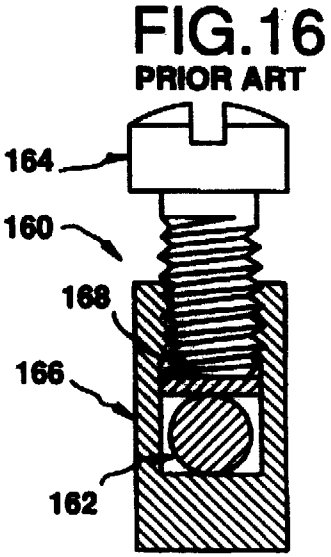
FIG.16 PRIOR ART
FIG. 16 illustrates a typical prior art EURO type terminal which secures the conductor(s) of one or more wires between the end of a screw which is secured in a threaded clamp/conductive terminal.

FIG. 16 illustrates a typical prior art EURO type terminal 160 which secures the conductor(s) 162 of one or more wires between the end of a screw 164, along the center line of the screw shank, and a threaded, conductive terminal clamp 166 or threaded clamp/conductive terminal 168 in combination. EURO type terminals are commonly arranged into elongated insulators to form EURO terminal blocks. There are many examples of EURO type terminals attached to female contacts arranged in a single row into an elongated insulator to form depluggable EURO terminal blocks, which may be mated to a shrouded pin header.

Figure 1:
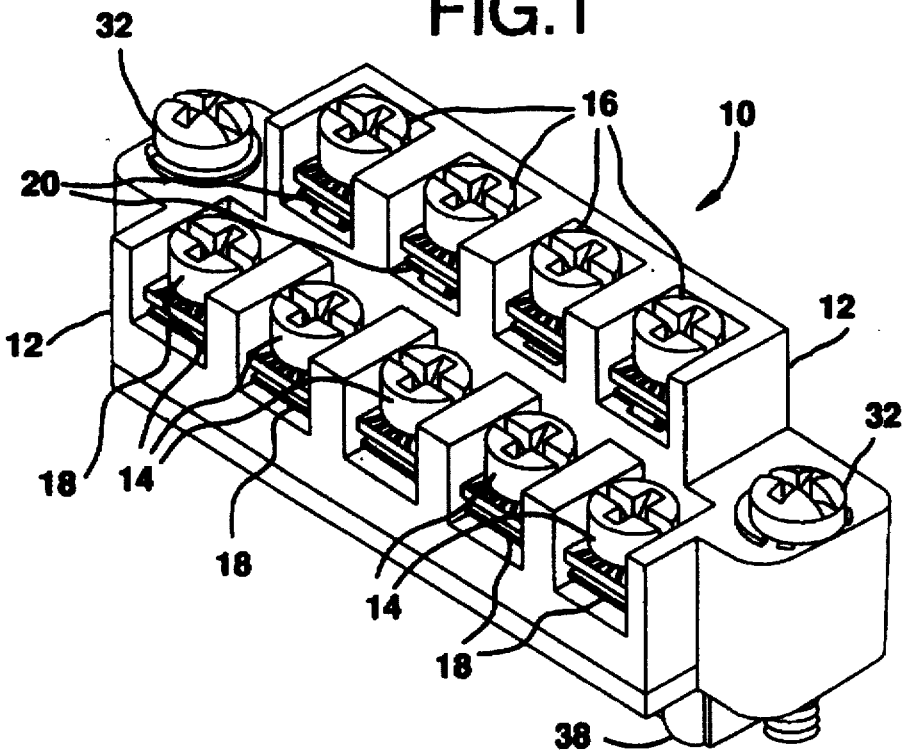
FIG. 1 illustrates a perspective view of a first embodiment of a screw type pluggable barrier terminal strip constructed pursuant to the teachings of the present invention.
Figure 2:
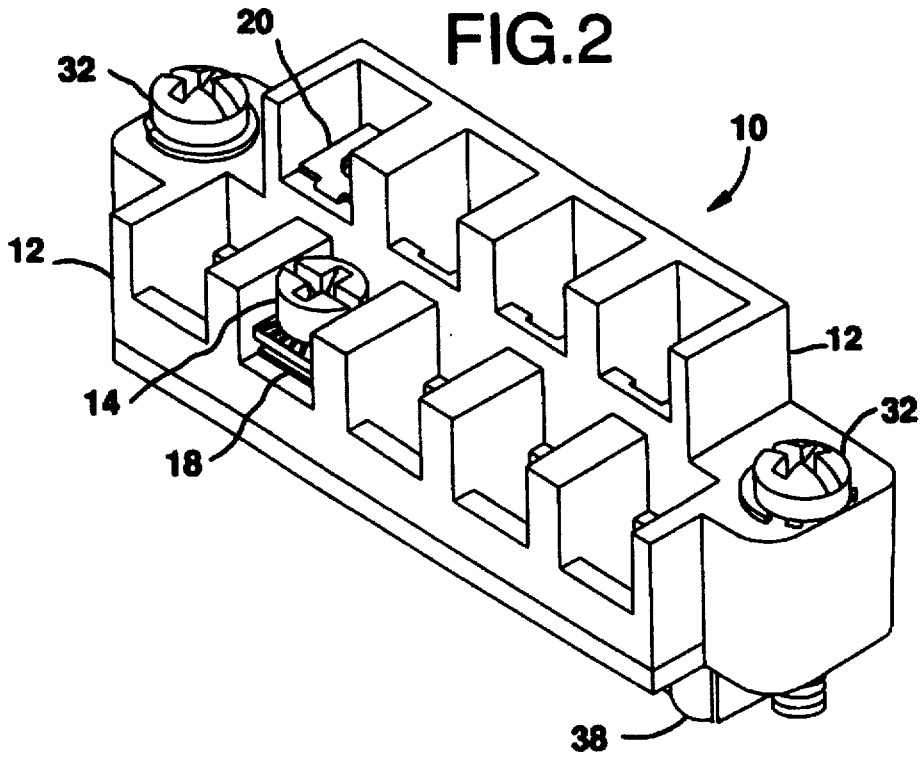
FIG. 2 is a partially disassembled view of the screw type pluggable barrier terminal strip of FIG. 1, illustrating further details of its construction.

FIG. 1 illustrates a perspective view of a first embodiment of a screw type pluggable barrier terminal strip 10 constructed pursuant to the teachings of the present invention. FIG. 2 is a partially disassembled view of the screw type pluggable barrier terminal strip 10 of FIG. 1, illustrating further details of its construction. The terminal strip 10 comprises an insulated housing 12 which defines seats for both a lower row of five screw wiring terminals 14 and an upper row of four screw wiring terminals 16. The screw wiring terminals can be of the same general type as illustrated in Figure 15, or a conductive terminal and backing nut in combination as described herein. The lower and upper rows are staggered with respect to each other such that each screw wiring terminal 16 in the upper row is positioned midway between two screw wiring terminals 14 in the lower row. The staggered rows are offset by a half pitch to improve visibility and accessibility to the lower screw wiring terminals 14. The screw wiring terminals can be arranged and dimensioned pursuant to NEMA standards, although other non-NEMA embodiments are also contemplated by the present invention.

Figure 6:
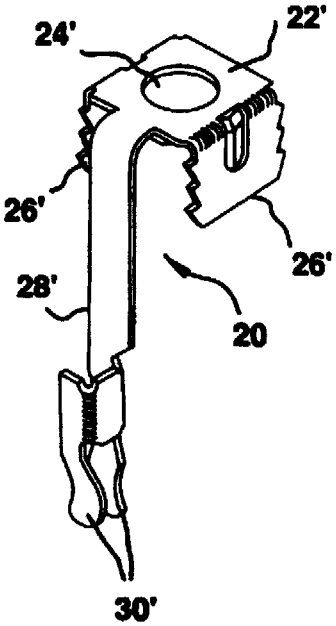
FIGS. 5 and 6 are perspective views of embodiments of electrical terminals which are suitable for use in the barrier terminal strip of FIGS. 1 and 2, with FIG. 5 showing a short terminal for use with the lower row of screw type wiring terminals, and FIG. 6 showing a long terminal for use with the upper row of screw type wiring terminals.

FIGS. 5 and 6 are perspective views of embodiments of electrical terminals which are suitable for use in the barrier terminal strip of FIGS. 1 and 2, with FIG. 5 showing a short electrical terminal 18 for use with the lower row of screw type wiring terminals 14 and FIG. 6 showing a long electrical terminal 20 for use with the upper row of screw type wiring terminals. Each terminal 18 and 20 defines an upper contact area respectively 22, 22' with a hole 24, 24' therein, through which a screw is inserted. The contact area 22 includes two downwarding extending projections 26, 26' which extend downwardly into the insulated housing 12. Each terminal 18 and 20 further includes a downwardly extending conductive tail 28, 28' which terminates in a female type of connector having a pair of opposed (praying hands or tulip shaped) contacts 30, 30' which are adapted to engage opposite sides of an electrical pin connector, and a threaded backing hex nut 31 (shown only in FIG. 5, but the terminal of FIG. 6 would normally have a similar threaded hex backing nut). The metallurgical properties of the conductive terminal materials normally don't provide the combination of spring operation of the tulip 30 and the strength and robustness required for threaded engagement stripout strength, which normally necessitates the use of a backing nut 31.

Figure 4:
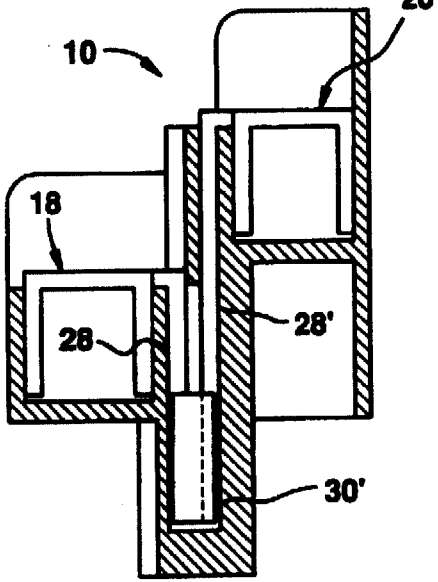
FIG. 4 is a side elevational and sectional view of a barrier terminal strip as in FIGS. 1 and 2, and shows the placement therein of electrical terminals as illustrated in FIGS. 5 and 6.

FIG. 4 is a side elevational and sectional view of a barrier terminal strip as in FIGS. 1 and 2, and shows the placement therein of electrical terminals 18 and 20 as illustrated in FIGS. 5 and 6. In an assembled state of the barrier terminal strip as shown in FIG. 4, the tails 28, 28' are arranged on opposite sides a centerline of the barrier terminal strip, along which the female contacts 30, 30' are positioned.

Figure 3A:
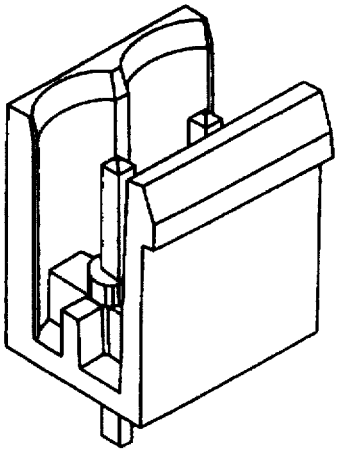
FIG. 3A is a perspective view of a standard header.
Figure 3:
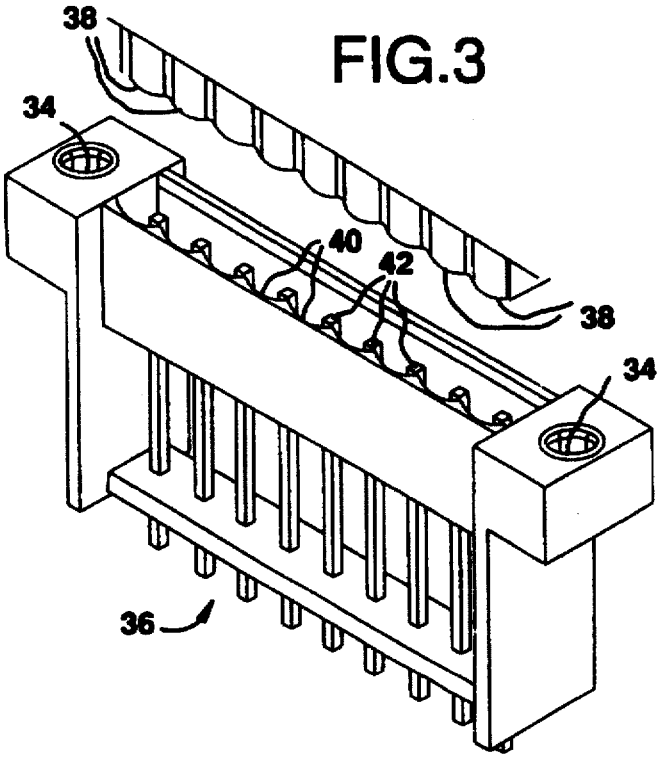
FIG. 3 is a perspective view of one embodiment of a nonstandard shrouded header, having a EURO style of contact pin arrangement in a shroud, which is adapted to be repeatedly connected, mechanically and electrically, with the screw type barrier terminal strip shown in FIGS. 1 and 2.

FIG. 3 is a perspective view of one embodiment of a nonstandard shrouded header, having a EURO style of contact pin arrangement, which is adapted to be repeatedly connected, mechanically and electrically, with the screw type barrier terminal strip shown in FIGS. 1 and 2. FIG. 3 is a perspective view of a standard shrouded header, also having a EURO style of contact pin arrangement.

Referring again to FIGS. 1 and 2, the pluggable barrier terminal strip 10 includes two screws 32 at opposite ends thereof for securing the barrier terminals strip in place, such as to two threaded connectors 34 embedded in the header 36 illustrated in FIG. 3. The barrier terminal strip 10 defines at its bottom a EURO style scallop shaped projection 38, illustrated best in FIG. 3, which is adapted to plug into the EURO style scallop shaped receptacle 40 in the EURO style header 36 shown in FIG. 3.

The arrangement is such that the screw type electrical barrier terminal strip 10 can be repeatedly connected, mechanically and electrically, with the EURO style header 36 which has a row of conductive pins 42, each of which is electrically connected to and encompassed by a pair of opposed female contacts 30. The row of pins 42 is secured in a nonconductive shroud of the header 36, as illustrated in FIG. 3. The pins can be in rows, nominally evenly spaced on centerlines, including but not limited to 3.5 mm, 3.81 mm, 5.0 mm, 5.08 mm, 7.5 mm, 7.62 mm and 8.26 mm.

In different embodiments, the pins 42 may or may not be secured within an outer nonconductive shroud as illustrated in FIG. 3. For instance, the barrier terminal strips illustrated in FIGS. 11–14 define flat bases such that the barrier terminal strips are adapted to rest directly upon a printed wiring or circuit board having a row of conductive pins projecting upwardly therefrom which are engaged by the row of opposed female contacts 30 in the barrier terminal strip.

Figure 2A:
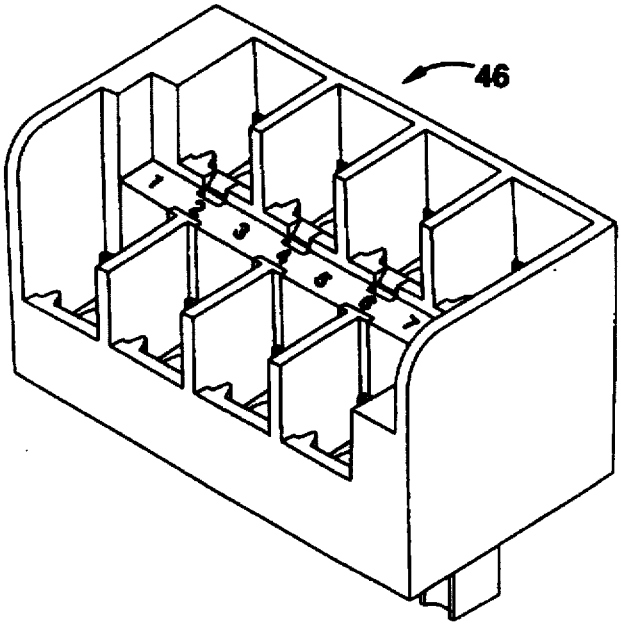
FIG. 2A illustrates an insulated housing for an embodiment of a screw type pluggable barrier terminal strip which defines 4 upper seats for 4 upper terminals and 4 lower seats for 4 lower terminals; with the 4 upper terminals being staggered by ½ pitch with respect to the 4 lower terminals.
Figure 10:
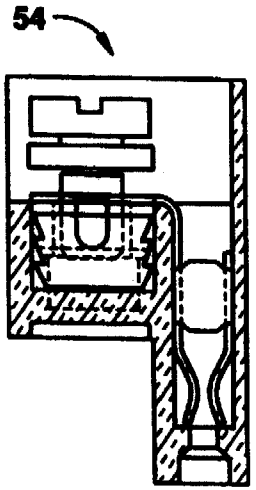
FIG. 10 illustrates a side sectional view of a barrier terminal strip similar to FIG. 9, but arranged in a single row.
Figure 9:
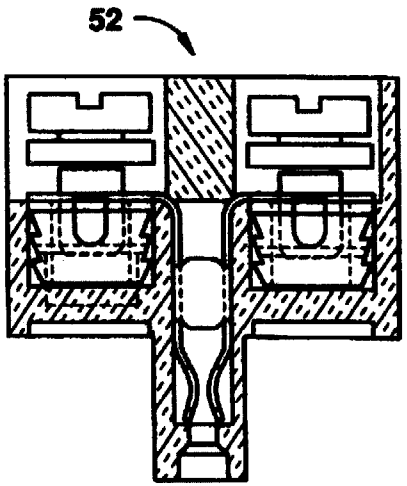
FIG. 9 illustrates a side sectional view of a screw type pluggable barrier terminal strip for connection, electrically and mechanical, to a shrouded header as shown in FIG. 3, and having a dual row, single height configuration.
Figure 8:
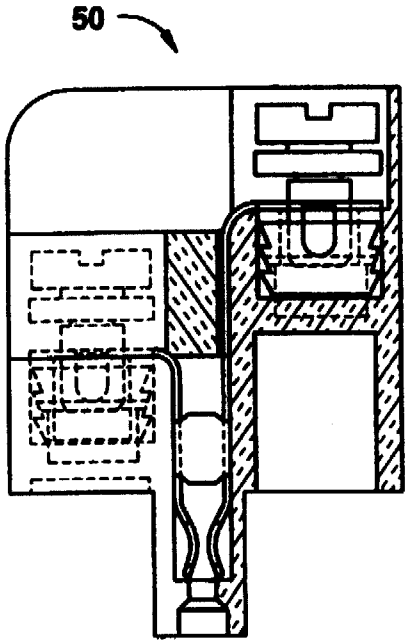
FIG. 8 illustrates an embodiment similar to FIG. 7, but with staggered rows.
Figure 7:
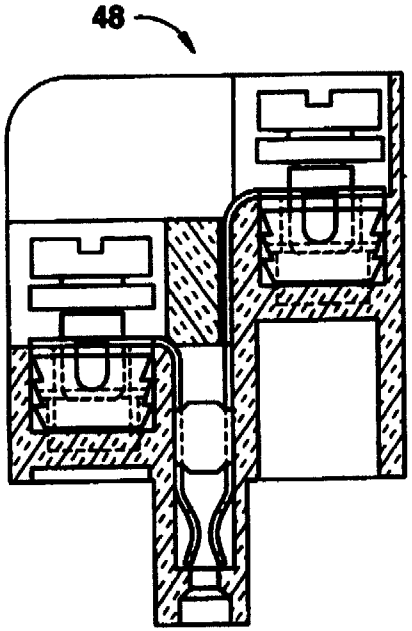
FIG. 7 illustrates a side sectional view of a screw type pluggable barrier terminal strip for connection, electrically and mechanically, to a shrouded header as shown in FIG. 3, without staggered rows.

FIG. 2A illustrates an insulated housing of a further embodiment of a screw type pluggable barrier terminal strip 46 which defines 4 upper seats for 4 upper terminals and 4 lower seats for 4 lower terminals, with the 4 upper terminals being staggered by ½ pitch with respect to the 4 lower terminals;

FIGS. 7–10 illustrate different embodiments of screw type pluggable barrier terminal strips for connection, electrically and mechanically, to a shrouded header as shown in FIG. 3. FIGS. 7 and 8 illustrate dual row, dual height embodiments, with the embodiment 48 of FIG. 7 being without staggered rows and the embodiment 50 of FIG. 8 being with staggered rows. The embodiment of FIG. 9 illustrates a dual row, single height barrier terminal strip 52 without staggered rows. The embodiment 54 of FIG. 10 illustrates a single row arrangement which functionally uses only alternate female connector pins therein because of the higher pitch of the row of female electrical terminals relative to the row of screw type electrical terminals.

In some embodiments of the present invention, an offset can be provided on the mating portion of the terminal block to equalize with the EURO plug or header.

Figure 14:
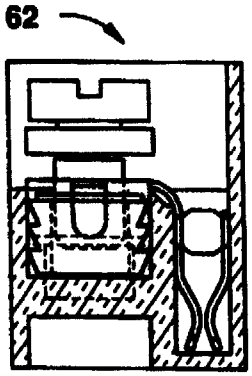
FIG. 14 illustrates an embodiment similar to FIG. 13 in a single row arrangement.
Figure 13:
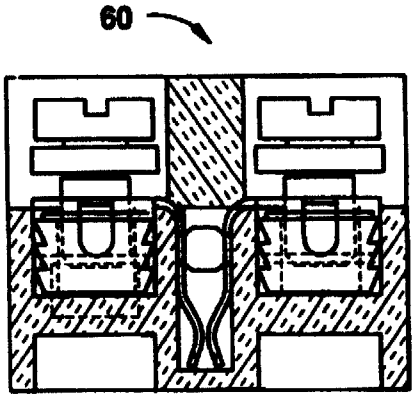
FIG. 13 illustrates a screw type pluggable barrier terminal strip for connection, mechanically and electrically, to a row of bare connector pins mounted in a printed wire or circuit board, in a dual row, single height barrier terminal strip.
Figure 12:
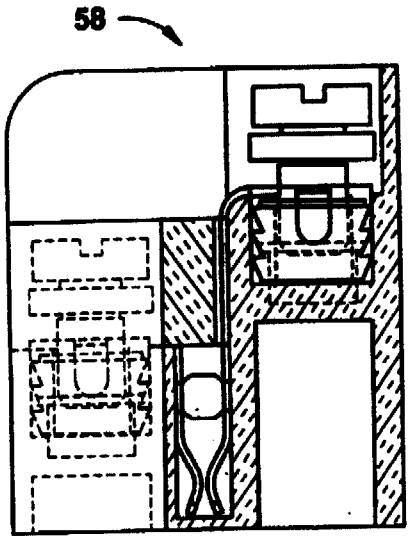
FIG. 12 illustrates an embodiment similar to Figure 11, but with staggered rows.
Figure 11:
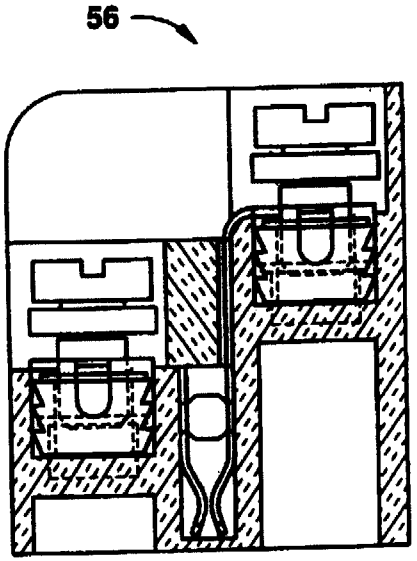
FIG. 11 illustrates a dual row, dual height embodiment of a screw type pluggable barrier terminal strip for connection, mechanically and electrically, to a row of bare connector pins mounted in a printed wire or circuit board, without staggered rows.

FIGS. 11–14 illustrate different embodiments of screw type pluggable barrier terminal strips for connection, mechanically and electrically, to a row of bare connector pins mounted in and projecting from a printed wire or circuit board. In general, the embodiments of FIGS. 11–14 are similar to the respective embodiments of FIGS. 7–10. The difference is that the embodiments of FIGS. 7–10 are designed to plug into a header as illustrated in FIG. 3, whereas the embodiments of FIGS. 11–14 are designed to plug into and connect to a row of conductive pins projecting from the surface of a printed wiring or circuit board. FIGS. 11 and 12 illustrate dual row, dual height embodiments, with the embodiment 56 of FIG. 11 being without staggered rows, and the embodiment 58 of FIG. 12 being with staggered rows. The embodiment of FIG. 13 illustrates a dual row, single height barrier terminal strip 60 without staggered rows. The embodiment 62 of FIG. 14 illustrates a single row arrangement which functionally uses only alternate pins therein because of the higher pitch of the row of female style electrical terminals relative to the row of screw type electrical terminals.

In general, the headers of FIGS. 11–14 are designed such that they remain substantially perpendicular to the printed circuit board during and after wave soldering. A hold-down can be provided at each end of the header to prevent tipping during PCB assembly and wave soldering. A board retention feature can also be placed in the center of each header, such as a barbed terminal or an electrically unconnected (offset) barbed terminal. More than one may be used to minimize header lift off from the printed circuit board. This retention also assists in strain relieving the header pins.

Different embodiments of the present invention can be provided with different pitches, different numbers and arrangements of contacts, and different lengths. One designed embodiment had twenty-one 0.400" pitch screw type terminals arranged in staggered dual rows, on dual heights interfacing to a single 0.200" pitch row of female contacts, which mated to a shrouded, single row pin header. Similar embodiments of 17 and 9 positions have been designed. Another designed embodiment had eight 0.300" pitch screw type terminals arranged in staggered dual rows, on dual heights interfacing to a single 0.150" pitch row of female contacts, which mated to a shrouded, single row header. Retention screws can be provided to thread into inserts at the ends of the headers. A further designed embodiment had five 0.400" pitch screw terminals arranged in a single row, interfacing with a single 0.400" pitch row of female contacts, which mated with individual printed circuit board mounted pins. A threaded insert can be provided to accept jack-out screws at the ends of the headers.

Pursuant to several designed embodiments, the plug contacts can have a 100–200μ" tin plating. A 30μ" min. gold over 50μ" min. nickel plating can be provided on the contact area meeting the header. The entire contact can have 30μ" min. gold over 50μ" min. nickel plating. The NEMA plug contact area meeting the pressure plates can have 100–200μ" tin plating. This plating can be 30μ" min. gold over 50μ" min. nickel.

While several embodiments and variations of the present invention for a depluggable barrier terminal strip are described in detail herein, it should be apparent that the disclosure and teachings of the present invention will suggest many alternative designs to those skilled in the art.

What is claimed:

1. A depluggable barrier terminal strip connector for repeated mating, electrically and mechanically, with a single row of conductive male connector pins, comprising:

a. at least one row of external conductor clamped, threaded terminals defining a first given pitch between adjacent external conductor clamped, threaded terminals;

b. a single row of spring-biased electrical contact female connectors defining a second given pitch between adjacent female connectors, which is a higher pitch than the first pitch between adjacent external conductor clamped, threaded terminals, with individual female connectors being electrically connected to individual external conductor clamped, threaded terminals, whereby the single row of spring-biased electrical contact female connectors can be repeatedly connected, mechanically and electrically, with a single row of conductive male connector pins.

2. A depluggable barrier terminal strip connector as claimed in claim 1, wherein the at least one row of threaded terminals includes first and second adjacent rows of threaded terminals, with the first row of threaded terminals being positioned on a first side of the single row of female connectors, and the second row of threaded terminals being positioned on a second side of the single row of female connectors, with individual female connectors in the row being connected alternately with a threaded terminal from the first row and a threaded terminal from the second row.

3. A depluggable barrier terminal strip connector as claimed in claim 2, wherein the first and second rows of threaded terminals are arranged in a NEMA format.

4. A depluggable barrier terminal strip connector as claimed in claim 2, wherein the single row of female connectors is arranged in a EURO format.

5. A depluggable barrier terminal strip connector as claimed in claim 4, wherein the single row of female connectors is housed within a shroud.

6. A depluggable barrier terminal strip connector as claimed in claim 4, wherein the single row of female connectors is housed within a EURO style, scallop shaped shroud, for connection to a row of conductor pins in a EURO style scallop shaped header.

7. A depluggable barrier terminal strip connector as claimed in claim 2, wherein the single row of female connectors is arranged near a flat bottom surface of the barrier terminal strip connector, for connection to a row of conductor pins projecting from a printed wiring or circuit board, with the flat bottom surface seated against a flat surface of the printed wiring or circuit board.

8. A depluggable barrier terminal strip connector as claimed in claim 2, wherein the first and second adjacent rows of threaded terminals are positioned at first and second different heights with respect to the single row of female connectors.

9. A depluggable barrier terminal strip connector as claimed in claim 8, wherein the first and second rows of threaded terminals are staggered with respect to each other, such that the first and second rows of the threaded terminals are a fraction of a pitch apart with respect to each other.

10. A depluggable barrier terminal strip connector as claimed in claim 8, wherein the first and second rows of threaded terminals are positioned in line with respect to each other in a nonstaggered manner, such that the first and second rows of threaded terminals are positioned aligned with respect to each other.

11. A depluggable barrier terminal strip connector as claimed in claim 2, wherein the first and second adjacent row of threaded terminals are positioned at the same height with respect to the single row of female connectors.

12. A depluggable barrier terminal strip connector as claimed in claim 11, wherein the first and second rows of threaded terminals are staggered with respect to each other, such that the first and second rows of the threaded terminals are a fraction of a pitch apart with respect to each other.

13. A depluggable barrier terminal strip connector as claimed in claim 11, wherein the first and second rows of threaded terminals are positioned in line with respect to each other in a nonstaggered manner, such that the first and second rows of threaded terminals are positioned with their pitches aligned with respect to each other.

14. A depluggable barrier terminal strip connector as claimed in claim 1, wherein the threaded terminals are arranged in a single row, and the threaded terminals are connected to alternate ones of the row of the female connectors.

15. A depluggable barrier terminal strip connector as claimed in claim 2, wherein the first and second rows of threaded terminals are spaced unequal distances on each side of the single row of female connectors.

16. A depluggable barrier terminal strip connector as claimed in claim 2, wherein the first and second rows of the threaded terminals are spaced unequal distances on each side of the single row of female connectors.

17. A depluggable barrier terminal strip connector as claimed in claim 1, in combination with a pluggable header having the single row of male connector pins defining the same second given pitch between adjacent male connector pins as the second given pitch between adjacent female connectors in the barrier terminal strip connector, such that the single row of female connectors of the barrier terminal strip connector can be repeatedly connected, mechanically and electrically, with the single row of male connector pins in the pluggable header.

18. A depluggable barrier terminal strip connector as claimed in claim 1, in combination with a printed wire or circuit board having the single row of male connector pins defining the same second given pitch between adjacent male connector pins as the second given pitch between adjacent female connectors in the barrier terminal strip connector, such that the single row of female connectors of the barrier terminal strip connector can be repeatedly connected, mechanically and electrically, with the single row of male connector pins in the printed wire or circuit board.

19. A depluggable barrier terminal strip connector as claimed in claim 1, where the external conductor clamped, threaded terminals comprise screw terminals.

20. A depluggable barrier terminal strip connector as claimed in claim 1, wherein the at least one row of threaded terminals includes first and second adjacent rows of threaded terminals.

* * * * *